US007030069B2

(12) United States Patent
Gupta et al.

(10) Patent No.: US 7,030,069 B2
(45) Date of Patent: Apr. 18, 2006

(54) LIQUID DETERGENT COMPOSITION

(75) Inventors: Neeraj Gupta, Vlaardingen (NL); Sachindew Manodjkoemar Ramcharan, Vlaardingen (NL); Simon Marinus Veerman, Vlaardingen (NL); Patrick Zwamborn, Vlaardingen (NL)

(73) Assignee: Unilever Home and Personal Care USA Division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/994,689

(22) Filed: Nov. 22, 2004

(65) Prior Publication Data

US 2005/0130859 A1 Jun. 16, 2005

(30) Foreign Application Priority Data

Dec. 5, 2003 (EP) ..... 03078827

(51) Int. Cl.
*C11D 17/00* (2006.01)

(52) U.S. Cl. ..... 510/101; 510/276; 510/353; 510/357; 510/389; 510/492; 510/425; 510/481

(58) Field of Classification Search ..... 510/276, 510/483, 392, 481, 101, 499
See application file for complete search history.

(56) References Cited

U.S. PATENT DOCUMENTS

| | | | | |
|---|---|---|---|---|
| 4,077,911 | A | 3/1978 | Okumura et al. | 252/550 |
| 4,717,507 | A | 1/1988 | Schwadtke et al. | 252/548 |
| 5,071,573 | A * | 12/1991 | Coffindaffer et al. | 510/328 |
| 5,174,912 | A * | 12/1992 | Coffindaffer et al. | 510/328 |
| 2002/0169097 | A1* | 11/2002 | Kasturi et al. | 510/317 |
| 2004/0058840 | A1* | 3/2004 | Hsu et al. | 510/424 |
| 2004/0077520 | A1* | 4/2004 | Foley et al. | 512/1 |

FOREIGN PATENT DOCUMENTS

| | | |
|---|---|---|
| EP | 042 648 | 12/1981 |
| EP | 224 971 | 6/1987 |
| EP | 370 596 | 5/1990 |
| EP | 380 406 | 8/1990 |
| EP | 592 947 | 4/1994 |
| WO | 88/03162 | 5/1988 |
| WO | 99/57233 | 11/1999 |

OTHER PUBLICATIONS

Search Report in an EP application, EP 03 07 8827.
Japanese Abstract JP 2000 212599—published Aug. 2, 2000.
Japanese Abstract JP 2003 049195—published Feb. 21, 2003.
Japanese Abstract JP 2001 254099—published Sep. 18, 2001.
PCT International Search Report in a PCT application, PCT/EP2004/013147.

* cited by examiner

*Primary Examiner*—Necholus Ogden
(74) *Attorney, Agent, or Firm*—Rimma Mitelman

(57) ABSTRACT

The present invention provides a liquid laundry detergent composition, comprising surfactant material other than fatty acid soap, an effective amount of a water-soluble dye, an enzyme and from 1% to 20% wt of fatty acid soap having from 12 to 20 C atoms, wherein at least 1% by weight (based on the liquid composition) of the fatty acid soap is unsaturated. In addition said composition comprises from 0.01% to 3% wt of a perfume composition and from 0.001% to 2% by weight of an antioxidant. It was found that the color characteristics of said composition do not deteriorate during storage.

4 Claims, No Drawings

LIQUID DETERGENT COMPOSITION

FIELD OF THE INVENTION

The present invention relates to a liquid laundry detergent composition containing a dye material, wherein the colour of the composition is maintained during storage of the composition, particularly when stored in sunlight.

BACKGROUND OF THE INVENTION

In liquid laundry detergent compositions, especially those for the washing of textile fabrics, it is common to include one or more soap and/or non-soap surfactant materials for assisting removal of various kinds of soil.

It is also common to add one or more perfume components to liquid laundry detergent compositions so as to render such compositions as well as the fabrics treated with them an attractive smell.

Nowadays, more and more detergent liquids are coloured and are sold in transparent bottles because this has proven to be appealing to the customer. Hence, the colour stability of detergent liquids has become significantly more important in recent times.

EP-A-380,406 discloses a liquid laundry detergent composition containing non-soap surfactant material, coconut fatty acid soap, a perfume and a dye material. Furthermore, WO-88/03162 discloses a liquid laundry detergent composition containing non-soap surfactant material, fatty acid soap based on an oleic acid/coconut fatty acid mixture and a mixture of perfume, dye, opacifying agent and optical brightener. A rather similar type of liquid laundry detergent composition comprising non-soap surfactant, palm kernel fatty acid soap and a mixture of perfume, dye preservative and polymer is disclosed in EP-A-592,947. Furthermore, U.S. Pat. No. 4,077,911 discloses a colored liquid detergent composition containing a colorant of the coal-tar type and butylated hydroxytoluene.

We have now found that perfumes in combination with fatty acid soaps generally can have a negative influence on the dye present in the liquid detergent composition. In particular, we have found that perfumes in combination with fatty acid soaps with at least some degree of unsaturation can have a significant negative effect on colour of the composition, during prolonged storage of the liquid laundry detergent composition, particularly if said composition also contains an enzyme.

In view of this, it is an object of the present invention to provide a liquid laundry detergent composition containing a fatty acid soap, a perfume composition, a dye material and an enzyme, wherein the colour of the composition is not negatively effected during prolonged storage, particularly when stored in sunlight.

We have surprisingly found that this object can be achieved by adding an anti-oxidant to said liquid laundry detergent composition. In other words, we have found that a dye-containing liquid laundry detergent composition which further contains a fatty acid soap, a perfume composition and an enzyme, and wherein the characteristics of the dye do not deteriorate during storage, can be obtained when that composition further contains an antioxidant as further specified in the claims.

It should be noted in this connection that the dye deterioration is not only induced by exposure of light but can also occur in the dark as well as when storing the composition at higher temperatures. Without wishing to be bound by any theory, it is postulated that the dyes do not produce stable colours probably due to oxidative processes that can—at least—be reduced by the addition of an antioxidant.

Definition of the Invention

Accordingly, in one aspect the present invention provides a liquid laundry detergent composition comprising:

(a) from 5% to 70% by weight of surfactant material other than fatty acid soap;

(b) from 1% to 20% by weight of a fatty acid soap having from 12 to 20 C atoms;

(c) from 0.01% to 3% by weight of a perfume composition;

(d) an effective amount of a water soluble dye material;

(e) an effective amount of an enzyme; and (f) from 0.001% to 2% by weight of an antioxidant selected from the group consisting of an alkylated phenol (as defined herein) α-, β-, γ-, δ-tocopherol, ethoxyquine, 2,2,4-trimethyl-1,2-dihydroquinoline, 2,6-di-tert-butyl hydroquinone, tert-butyl-hydroxy anysole, lignosulphonic acid and salts thereof, 6-hydroxy-2,5,7,8-tetra-methylchroman-2-carboxylic acid (Trolox™), 1,2-benzisothiazoline-3-one (Proxel GXL™), a benzofuran or benzopyran derivative (as defined herein), tocopherol sorbate, butylated hydroxy benzoic acid and its salts, gallic acid and its alkyl esters, uric acid and its salts and alkyl esters, sorbic acid and its salts, dihydroxy fumaric acid and its salts, and mixtures thereof.

Furthermore, in a second aspect the invention provides a method of cleaning a fabric substrate, comprising the steps of treating the substrate with a liquid composition of the present invention in an aqueous environment, rinsing the substrate and drying it.

DETAILED DESCRIPTION OF THE INVENTION

The Liquid Detergent Composition

Liquid laundry detergent compositions generally can be considered either to be isotropic or structured. The liquid cleaning composition may be formulated as a concentrated cleaning liquid for direct application to a substrate, or for application to a substrate following dilution, such as dilution before or during use of the liquid composition by the consumer or in washing apparatus.

The composition and method according to the present invention can be used for cleaning a laundry fabric substrate. Cleaning may be carried out by simply leaving the substrate in contact for a sufficient period of time with a liquid medium constituted by or prepared from the liquid cleaning composition. Preferably, however, the cleaning medium on or containing the substrate is agitated.

Product Form

The liquid detergent composition according to the present invention is preferably a concentrated liquid cleaning composition. Furthermore, said liquid detergent composition is preferably isotropic.

It should be understood that the liquid compositions according to any aspect of the present invention have a physical form which preferably ranges from a pourable liquid, a pourable gel to a non-pourable gel. These forms are conveniently characterised by the product viscosity. In these definitions, and unless indicated explicitly to the contrary, throughout this specification, all stated viscosities are those measured at a shear rate of 21 $s^{-1}$ and at a temperature of 25° C.

Liquid compositions according to any aspect of the present invention preferably have a viscosity of no more than 1,500 mPa·s, more preferably no more than 1,000 mPa·s, still more preferably, no more than 500 mPa·s.

Compositions according to any aspect of the present invention which are pourable gels, preferably have a viscosity of at least 1,500 mPa·s but no more than 6,000 mPa·s, more preferably no more than 4,000 mPa·s, still more preferably no more than 3,000 mPa·s and especially no more than 2,000 mPa·s.

Compositions according to any aspect of the present invention which are non-pourable gels, preferably have a viscosity of at least 6,000 mPa·s but no more than 12,000 mPa·s, more preferably no more than 10,000 mPa·s, still more preferably no more than 8,000 mPa·s and especially no more than 7,000 mPa·s.

Physically Stable

For the purpose of this invention a composition is physically stable when less than 2% phase separation occurs after 2 week storage at 37° C. With isotropic liquids this phase separation generally starts with the liquid becoming hazy.

Water

Preferably, the liquid detergent composition of the invention is aqueous: the amount of water in said liquid composition is desirably from 5% to 95%, more preferably from 30% to 80%, by weight.

The Fatty Acid Soap

The liquid laundry detergent composition of the invention comprises from 1% to 20%, preferably from 2% to 10%, by weight of a fatty acid soap having from 12 to 20 C atoms.

At least 1% by weight, preferably at least 5% by weight, based on the liquid composition of the fatty acid soap is unsaturated, containing one or more double bonds.

Fatty acids suitable for forming the soap of the present invention include lauric, myristic, palmitic, oleic, linoleic, linolenic acid, and mixtures thereof.

Naturally obtainable fatty acids which are usually complex mixtures, are also suitable (such as tallow, coconut, and palm kernel fatty acids).

Most preferred fatty acids for producing the soap of the invention are selected from oleic fatty acid, coconut fatty acid and palm kernel fatty acid.

Suitable cations for use in the fatty acid soap of the invention include sodium, potassium, ammonium, monoethanol ammonium, diethanol ammonium, triethanol ammonium, such as tetramethyl ammonium up to tetradecyl ammonium, cations.

The Dye Material

The liquid laundry detergent composition of the invention comprises an effective amount of a water soluble dye material. The concentration of the dye material in said liquid composition is preferably from 0.0001% to 0.5% by weight. Suitable dye materials for use in the present invention are anthraquinone-based dyes, azo-based dyes and triarylmethane-based dyes. The dye material is preferably selected from acid blue, acid red, acid yellow, acid green, and acid violet. The most preferred dye materials are acid blue 80, brilliant blue and patent blue.

The Antioxidant

The liquid detergent composition of the invention comprises 0.001 to 2% by weight of an antioxidant. Preferably, the antioxidant is present at a concentration in the range 0.01 to 0.08% by weight.

Anti-oxidants are substances as described in Kirk-Othmers (Vol 3, pg 424) and in Uhlmans Encyclopedia (Vol 3, pg 91).

One class of anti-oxidants used in the present invention is alkylated phenols, having the general formula:

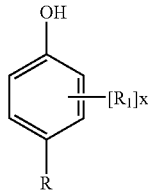

wherein R is $C_1$–$C_{22}$ linear or branched alkyl, preferably methyl or branched $C_3$–$C_6$ alkyl; $C_3$–$C_6$ alkoxy, preferably methoxy; $R_1$ is a $C_3$–$C_6$ branched alkyl, preferably tert-butyl; x is 1 or 2. Hindered phenolic compounds are a preferred type of alkylated phenols having this formula. A preferred hindered phenolic compound of this type is 2,6-di-tert-butyl-hydroxy-toluene (BHT).

Furthermore, the anti-oxidant used in the composition of the present invention is selected from the group consisting of α-, β-, γ-, δ-tocopherol, ethoxyquine, 2,2,4-trimethyl-1,2-dihydroquinoline, 2,6-di-tert-butyl-hydroquinone, tert-butyl-hydroxy anisole, lignosulphonic acid and salts thereof, and mixtures thereof. It is noted that ethoxyquine (1,2-dihydro-6-ethoxy-2,2,4-trimethylchinolin) is marketed under the name Raluquin™ by the company Rashig™.

Other types of antioxidant used in the present invention are 6-hydroxy-2,5,7,8-tetra-methylchroman-2-carboxylic acid (Trolox™) and 1,2-benzisothiazoline-3-one (Proxel GXL™).

A further class of anti-oxidants which may be suitable for use in the present invention is a benzofuran or benzopyran derivative having the formula:

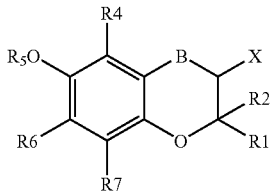

wherein $R_1$ and $R_2$ are each independently alkyl or $R_1$ and $R_2$ can be taken together to form a $C_5$–$C_6$ cyclic hydrocarbyl moiety; B is absent or $CH_2$; $R_4$ is $C_1$–$C_6$ alkyl; $R_5$ is hydrogen or —C(O)$R_3$ wherein $R_3$ is hydrogen or $C_1$–$C_{19}$ alkyl; $R_6$ is $C_1$–$C_6$ alkyl; $R_7$ is hydrogen or $C_1$–$C_6$ alkyl; X is —$CH_2OH$, or —$CH_2A$ wherein A is a nitrogen comprising unit, phenyl, or substituted phenyl. Preferred nitrogen comprising A units include amino, pyrrolidino, piperidino, morpholino, piperazino, and mixtures thereof.

Anti-oxidants such as tocopherol sorbate, butylated hydroxy benzoic acids and their salts, gallic acid and its alkyl esters, uric acid and its salts and alkyl esters, sorbic acid and its salts, and dihydroxy fumaric acid and its salts may also be used. The most preferred types of anti-oxidant for use in the present invention are 2,6-di-tert-butyl-hydroxy-toluene (BHT), α-, β-, γ-, δ-tocopherol, 1,2-benzisothiazoline-3-one (Proxel GXL™) and mixtures thereof.

Perfume Component

The liquid composition of the present invention comprises between 0.01 to 3 wt/wt % of a perfume composition, preferably between 0.1 to 2 wt/wt % of a perfume composition. Said perfume composition preferably comprises at least 0.1% by weight based on the liquid composition of a perfume component selected from terpene, ketone, aldehydic perfume and mixtures thereof. The perfume composition may fully consist of the perfume component but generally the perfume composition is a complex mixture of perfumes of various differing perfume classifications. In this regard, the perfume composition preferably comprises at least 1.0%, more preferably at least 5% by weight of the perfume component. At higher levels of the perfume component, the importance of the antioxidant is greater.

Having regard to the terpene perfume component, the present invention has particular utility with the following preferred terpene perfume components:

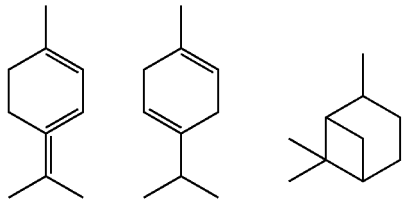

terpinolene Gamma-terpinene pinane

Having regard to the ketone perfume component, the present invention has particular utility to the following preferred ketonic perfume components:

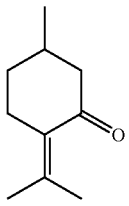

pulegone

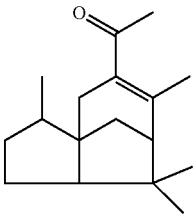

vertofix coeur

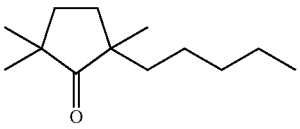

veloutone

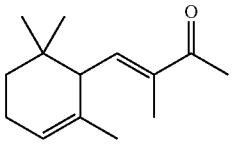

Alpha-methylionone

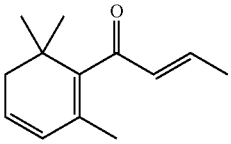

damascenone

With regard to the aldehydic perfume component, the present invention has particular utility with the following preferred aldehydic perfume components:

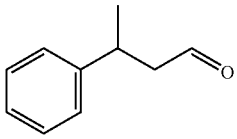

trifernal

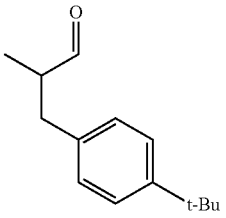

lilial

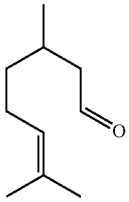

citronellal

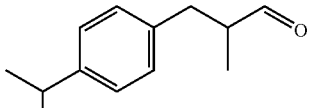

cyclosal

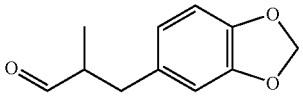

heliopropanal

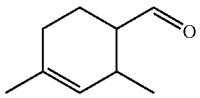

zestover

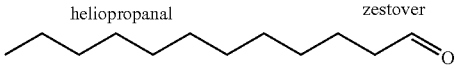

Aldehyde C12

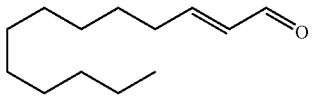

tridecylenicaldehyde

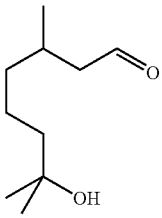

Cyclosia base

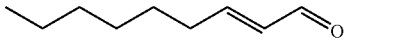

octenal

Enzymes

The liquid detergent composition of the invention additionally contains an effective amount of one or more enzymes.

"Detersive enzyme", as used herein, means any enzyme having a cleaning, stain removing or otherwise beneficial effect in a laundry application. Enzymes are included in the present detergent compositions for a variety of purposes, including removal of protein-based, saccharide-based, or triglyceride-based stains, for the prevention of refugee dye transfer, and for fabric restoration.

The composition of the invention contains an enzyme selected from a protease, a lipase and mixtures thereof. Preferably, said composition contains a protease enzyme. Other suitable enzymes include amylases, cellulases, peroxidases, and mixtures thereof of any suitable origin, such as vegetable, animal, bacterial, fungal and yeast origin. Preferred selections are influenced by factors such as pH-activity and/or stability optima, thermo-stability, and stability to active detergents, builders and the like. In this respect bacterial or fungal enzymes are preferred, such as bacterial amylases and proteases, and fungal cellulases.

Enzymes are normally incorporated into detergent or detergent additive compositions at levels sufficient to provide a "cleaning-effective amount". The term "cleaning effective amount" refers to any amount capable of producing a cleaning, stain removal, soil removal, whitening, deodorizing, or freshness improving effect on substrates such as fabrics. In practical terms for current commercial preparations, typical amounts are up to about 5 mg by weight, more typically 0.001 mg to 3 mg, of active enzyme per gram of the detergent composition. Stated otherwise, the compositions herein will typically comprise from 0.0001% to 10%, preferably from 0.001% to 5%, more preferably 0.005%–1% by weight of a commercial enzyme preparation.

Surfactant

The liquid composition of the invention comprises from 5 to 70%, preferably from 10 to 60% by weight of a surfactant other than fatty acid soap. This surfactant material is preferably selected from anionic, nonionic, cationic, zwitterionic active detergent materials or mixtures thereof. Most preferably, the compositions herein comprise 15 to 40% by weight of this surfactant.

Non-limiting examples of surfactants useful herein typically at levels from about 10% to about 50%, by weight, include the conventional $C_{11}$–$C_{18}$ alkylbenzene sulphonates ("LAS"), the $C_{10}$–$C_{18}$ secondary (2,3) alkyl sulphates of the formula $CH_3(CH_2)_x(CHOSO_3\text{-}M^+)CH_3$ and $CH_3(CH_2)_y(CHOSO_3\text{-}M^+)CH_2CH_3$ where x and (y+1) are integers of at least about 7, preferably at least about 9, and M is a water-solubilising cation, especially sodium, unsaturated sulphates such as oleyl sulphate, C10–C18 alkyl alkoxy carboxylates (especially the EO 1-7 ethoxycarboxylates), the C10–C18 glycerol ethers, the C10–C18alkyl polyglycosides and their corresponding sulphated polyglycosides, and C12–C18 alpha-sulphonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulphobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO-92/06,154. Other sugar-derived surfactants include the N-alkoxy polyhydroxy fatty acid amides, such as $C_{10}$–$C_{18}$ N-(3-methoxypropyl) glucamide. $C_{10}$–$C_{20}$ conventional soaps may also be used.

Other anionic surfactants useful for detersive purposes can also be included in the liquid compositions hereof. These can include salts (including, for example, sodium potassium, ammonium, and substituted ammonium salts such a mono-, di- and triethanolamine salts) of soap, $C_9$–$C_{20}$ linear alkylbenzenesulphonates, $C_8$–$C_{22}$ primary or secondary alkanesulphonates, $C_8$–$C_{24}$ olefinsulphonates, sulphonated polycarboxylic acids, alkyl glycerol sulphonates, fatty acyl glycerol sulphonates, fatty oleyl glycerol sulphates, alkyl phenol ethylene oxide ether sulphates, paraffin sulphonates, alkyl phosphates, isothionates such as the acyl isothionates, N-acyl taurates, fatty acid amides of methyl tauride, alkyl succinamates and sulphosuccinates, monoesters of sulphosuccinate (especially saturated and unsaturated $C_{12}$–$C_{18}$ monoesters) diesters of sulphosuccinate (especially saturated and unsaturated $C_6$–$C_{14}$ diesters), N-acyl sarcosinates, sulphates of alkylpolysaccharides such as the sulphates of alkylpolyglucoside, branched primary alkyl sulphates, alkyl polyethoxy carboxylates such as those of the formula $RO(CH_2CH_2O)_kCH_2COO\text{-}M^+$ wherein R is a $C_8$–$C_{22}$ alkyl, k is an integer from 0 to 10, and M is a soluble salt-forming cation, and fatty acids esterified with isethionic acid and neutralised with sodium hydroxide. Further examples are given in Surface Active Agents and Detergents (Vol. I and II by Schwartz, Perry and Berch).

The liquid detergent compositions of the present invention preferably comprise at least about 5%, preferably at least 10%, more preferably at least 12% and less than 70%, more preferably less than 60% by weight, of an anionic surfactant.

Alkyl sulphate surfactants, either primary or secondary, are a type of anionic surfactant of importance for use herein. Alkyl sulphates have the general formula $ROSO_3M$ wherein R preferably is a $C_{10}$–$C_{24}$ hydrocarbyl, preferably an alkyl straight or branched chain or hydroxyalkyl having a $C_{10}$–$C_{20}$ alkyl component, more preferably a $C_{12}$–$C_{18}$ alkyl or hydroxyalkyl, and M is hydrogen or a water soluble cation, e.g., an alkali metal cation (e.g., sodium potassium, lithium), substituted or unsubstituted ammonium cations such as methyl-, dimethyl-, and trimethyl ammonium and quaternary ammonium cations, e.g., tetramethyl-ammonium and dimethyl piperdinium, and cations derived from alkanolamines such as ethanolamine, diethanolamine, triethanolamine, and mixtures thereof, and the like.

Typically, alkyl chains of $C_{12}$–$C_{16}$ are preferred for lower wash temperatures (e.g., below about 50° C. and C16–C18 alkyl chains are preferred for higher wash temperatures (e.g., about 50° C.).

Alkyl alkoxylated sulphate surfactants are another category of preferred anionic surfactant. These surfactants are water soluble salts or acids typically of the formula $RO(A)mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is hydrogen or a water soluble cation which can be, for example, a metal cation (e.g., sodium, potassium, lithium, calcium, magnesium, etc.), ammonium or substituted-ammonium cation. Alkyl ethoxylated sulphates as well as alkyl propoxylated sulphates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines, e.g., monoethanolamine, diethanolamine, and triethanolamine, and mixtures thereof. Exemplary surfactants are $C_{12}$–$C_{18}$ alkyl polyethoxylate (1.0) sulphate, $C_{12}$–$C_{18}$ alkyl polyethoxylate (2.25) sulphate, $C_{12}$–$C_{18}$ alkyl polyethoxylate (3.0) sulphate, and $C_{12}$–$C_{18}$ alkyl polyethoxylate (4.0) sulphate wherein M is conveniently selected from sodium and potassium.

The liquid detergent compositions of the present invention preferably comprise at least about 5%, preferably at least 10%, more preferably at least 12% and less than 70%, more preferably less than 60% by weight, of a nonionic surfactant.

Preferred nonionic surfactants such as $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), block alkylene oxide condensate of C6 to $C_{12}$ alkyl phenols, alkylene oxide condensates of $C_8$–$C_{22}$ alkanols and ethylene oxide/propylene oxide block polymers (Pluronic™-BASF Corp.), as well as semi polar nonionics (e.g., amine oxides and phosphine oxides) can be used in the present liquid compositions. An extensive disclosure of these types of surfactants is found in U.S. Pat. No. 3,929,678.

Alkylpolysaccharides such as those disclosed in U.S. Pat. No. 4,565,647 are also preferred nonionic surfactants in the liquid compositions of the invention.

Further preferred nonionic surfactants are the polyhydroxy fatty acid amides. A particularly desirable surfactant of this type for use in the liquid compositions herein is alkyl-N-methyl glucamide.

Other sugar-derived surfactants include the N-alkoxy polyhydroxy fatty acid amides, such as $C_{10}$—$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used.

Mixtures of anionic and nonionic surfactants are especially suitable for use in the liquid detergent composition of the present invention.

Carriers

Liquid detergent compositions of the invention may suitably contain various solvents as carriers.

Low molecular weight primary or secondary alcohols exemplified by methanol, ethanol, propanol, and isopropanol are suitable. Other suitable carrier materials are glycols, such as mono-, di-, and tri-, propylene glycol, glycerol, and polyethylene glycols (PEG) having a molecular weight of from 200 to 5000. The compositions may contain from 1% to 50%, typically 5% to 30%, preferably 2% to 10%, by weight of such carriers.

Detergency Builder

One or more detergency builders may be suitably present in the liquid detergent composition of the invention.

Examples of suitable organic detergency builders, when present, include the alkaline metal, ammonium and substituted ammonium polyacetates, carboxylates, polycarboxylates, polyacetyl carboxylates, carboxymethyloxysuccinates, carboxymethyloxymalonates, ethylene diamine-N,N-disuccinic acid salts, polyepoxysuccinates, oxydiacetates, triethylene tetramine hexa-acetic acid salts, N-alkyl imino diacetates or dipropionates, alpha sulpho-fatty acid salts, dipicolinic acid salts, oxidised polysaccharides, polyhydroxysulphonates and mixtures thereof.

Specific examples include sodium, potassium, lithium, ammonium and substituted ammonium salts of ethylenediamino-tetraacetic acid, nitrilo-triacetic acid, oxydisuccinic acid, melitic acid, benzene polycarboxylic acids and citric acid, tartrate mono succinate and tartrate di succinate.

Other Optional Ingredients

The compositions herein can further comprise a variety of optional ingredients. A wide variety of other ingredients useful in detergent compositions can be included in the compositions herein, including other active ingredients, carriers, hydrotropes, processing aids, dyes or pigments, solvents for liquid formulations, etc.

Chelating Agents

The liquid detergent compositions herein may also optionally contain one or more iron, copper and/or manganese chelating agents. Such chelating agents can be selected from the group consisting of amino carboxylates, amino phosphonates, polyfunctionally-substituted aromatic chelating agents and mixtures therein, all as hereinafter defined.

If utilised, these chelating agents will generally comprise from about 0.1% to about 10% by weight of the detergent compositions herein. More preferably, if utilised the chelating agents will comprise from about 0.1% to about 3.0% by weight of such compositions.

Clay Soil Removal/Anti-redeposition Agents

The compositions of the present invention can also optionally contain water-soluble ethoxylated amines having clay soil removal and antiredeposition properties.

Liquid detergent compositions typically contain about 0.01% to about 5% of these agents.

One preferred soil release and anti-redeposition agent is ethoxylated tetraethylenepentamine. Exemplary ethoxylated amines are further described in U.S. Pat. No. 4,597,898, Other suitable anti-redeposition agents are based on polycarboxylates.

Brightener

Any optical brighteners or other brightening or whitening agents known in the art can be incorporated at levels typically from about 0.05% to about 1.2%, by weight, into the liquid detergent compositions herein. Commercial optical brighteners which may be useful in the present invention can be classified into subgroups, which include, but are not necessarily limited to, derivatives of stilbene, pyrazoline, cournarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Fabric Softeners

Various through-the-wash fabric softeners, especially the impalpable smectite clays of U.S. Pat. No. 4,062,647 as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners as disclosed, for example, in U.S. Pat. No. 4,375,416 and U.S. Pat. No. 4,291,071.

Dye Transfer Inhibiting Agents

The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

The invention will now be illustrated by way of the following non-limiting examples, in which all parts and percentages are by weight unless otherwise indicated.

EXAMPLES

The following 'base' liquid detergent composition was prepared:

| | % wt |
|---|---|
| Coconut fatty acid | 6.0 |
| NI 7EO | 16.0 |

-continued

| | % wt |
|---|---|
| sLES | 2.0 |
| Sodium hydroxide | 1.55 |
| Sodium chloride | 0.75 |
| Propylene Glycol | 3.0 |
| Phosphonate | 0.75 |
| Protease enzyme | 0.25 |
| Perfume | 0.75 |
| Dye - patent blue | 0.0003 |
| Preservatives | 0.015 |
| Water | balance to 100% |

wherein:

sLES=sodium lauryl ether sulphate (with on average 3 ethyleneoxide units);

NI 7EO=$C_{12}$–$C_{13}$ fatty alcohol ethoxylated with an average of 7 ethyleneoxide groups;

Phosphonate=diethylenetriamine penta (methylphosphonic acid) sodium salt.

Subsequently, vitamin E (tocopherol) was added to half of the total amount of this 'base' liquid detergent composition, at a concentration of 0.04% by weight.

Immediately thereafter, the following colour characteristics of both the 'base' liquid detergent composition (without the vitamin E) and the liquid detergent composition including the vitamin E ingredient were determined using a Spectrophotometer CM 3720d (ex Minolta), as a calorimeter:

the intensity or lightness of the colour (expressed as 'L'); and the chromaticity-coordinates 'a' and 'b', whereby 'L', 'a' and 'b' are expressed in arbitrary units;

the scale of 'L' is from +100 (pure white) to −100 (pure black);

a=positive value means a red colour, a=negative value means a green colour, b=positive value means a yellow colour, b=negative value means a blue colour, the scale of 'a' and 'b' ranges from +60 to −60, whereby at the absolute level of 60 full saturation of the colour is obtained.

After an 8-hours period of time during which both liquid compositions were exposed to Xe light (power of light: 500 W/$m^2$), these colour measurements were repeated.

The following results were obtained:

| | Initial (after 0 hr) | | |
|---|---|---|---|
| | L | a | b |
| Composition with vitamin E | 89.7 | −21.6 | −11.0 |
| Composition without vitamin E | 89.7 | −21.5 | −11.1 |

| | After 8 hr exposure | | |
|---|---|---|---|
| | L | a | b |
| Composition with vitamin E | 89.7 | −19.7 | −6.3 |
| Composition without vitamin E | 99.0 | −0.9 | +5.7 |

It can be derived from these results that the composition with vitamin E has maintained its colour to a large extent after the 8 hr period of exposure to Xe light.

On the other hand, the composition without vitamin E has become considerably lighter (shown by the increase of the L-value) and its colour has changed from green/blue (aquamarine) to light/yellow (shown by the change in 'a'- and 'b'-values).

The invention claimed is:

1. A liquid laundry detergent composition comprising:

(a) from 5% to 70% by weight of surfactant material other than fatty acid soap;

(b) from 2 to 10% by weight of a fatty acid soap selected from oleic fatty acid, coconut fatty acid and palm kernel fatty acid, wherein at least 1% by weight based on the liquid composition of the fatty acid soap is unsaturated;

(c) from 0.01% to 3% by weight of a perfume composition wherein the perfume composition comprises at least 0.1% by weight based on the liquid composition of a perfume component selected from terpene, ketone, aldehydic perfume and mixtures thereof;

(d) an effective amount of water soluble dye selected from the group consisting of anthraquinone-based, azo-based and triarylmethane-based;

(e) an effective amount of an enzyme; and (f) from 0.01% to 0.08% by weight of an antioxidant selected from the group consisting of 2,6-di-tert-butyl-hydroxy-toluene, α-, β-, γ-, δ-tocopherol, benzisothiazoline-3-one and mixtures thereof.

2. A liquid composition according to claim 1, wherein the composition comprises from 0.0001% to 0.5% by weight of the dye material.

3. A liquid composition according to claim 1, wherein the dye material is selected from acid blue 80, brilliant blue and patent blue.

4. A method of cleaning a fabric substrate, comprising the steps of treating the substrate with a liquid composition as defined in claim 1 in an aqueous environment, rinsing the substrate and drying it.

* * * * *